US005724707A

United States Patent [19]

Kirk et al.

[11] Patent Number: 5,724,707

[45] Date of Patent: Mar. 10, 1998

[54] INTERLOCK ATTACHING STRAP SYSTEM

[75] Inventors: John Kirk, Ashland, Mass.; Gerald E. Tatton, San Antonio, Tex.; Paul Dersain, Worcester, Mass.

[73] Assignee: The United States of America as represented by the Secretary of the Army, Washington, D.C.

[21] Appl. No.: 668,032

[22] Filed: Jun. 17, 1996

[51] Int. Cl.[6] ..... A44B 21/00

[52] U.S. Cl. ..... 24/3.7; 24/573.7; 2/102; 2/247; 224/675

[58] Field of Search ..... 224/675; 24/3.1, 24/3.5, 3.7, 3.9, 573.1, 573.7; 2/102, 247, 249

[56] References Cited

U.S. PATENT DOCUMENTS

| | | | |
|---|---|---|---|
| 761,113 | 5/1904 | Van Wagoner et al. | 24/573.7 |
| 842,498 | 1/1907 | Schmidt | 24/573.7 |
| 1,310,125 | 7/1919 | Lundberg . | |
| 1,655,895 | 1/1928 | Davis . | |
| 1,764,483 | 6/1930 | Watkins . | |
| 2,343,142 | 2/1944 | Freedman | 24/573.1 X |
| 2,557,445 | 6/1951 | Lewallen . | |
| 3,840,901 | 10/1974 | Eyster . | |
| 4,266,300 | 5/1981 | Partridge . | |
| 4,507,882 | 4/1985 | Harrell . | |
| 4,651,355 | 3/1987 | White . | |
| 4,923,105 | 5/1990 | Snyder | 224/675 X |
| 5,054,127 | 10/1991 | Zevchak . | |
| 5,063,127 | 11/1991 | McSheffery . | |
| 5,201,448 | 4/1993 | Schue | 224/675 |
| 5,259,093 | 11/1993 | D'Annunzio . | |
| 5,421,032 | 6/1995 | Murphy . | |
| 5,465,425 | 11/1995 | Crispin . | |

FOREIGN PATENT DOCUMENTS

| | | | |
|---|---|---|---|
| 642244 | 6/1962 | Canada | 24/573.7 |

*Primary Examiner*—James R. Brittain
*Attorney, Agent, or Firm*—Vincent J. Ranucci

[57] ABSTRACT

An interlocking attaching system for removably securing objects such as pockets to a garment. The system having at least one object and a garment, and where the object has at least one strap thereon for removably engaging the garment in an interlocking fashion. The garment and the object having webs thereon for removably receiving the straps in an interlocking fashion in order to effectively, removably mount the object to the garment.

17 Claims, 4 Drawing Sheets

INTERLOCK ATTACHING STRAP SYSTEM

STATEMENT OF GOVERNMENT INTEREST

The invention described herein maybe manufactured and used by and for the Government for governmental purposes without the payment of any royalties thereon.

FIELD OF THE INVENTION

The present invention relates generally to systems for attaching objects to garments, and, more particularly, to a fastening system that securely mounts removable pockets, pouches or the like to a textile surface without causing irritation to the user.

BACKGROUND OF THE INVENTION

It is well recognized that all types of modular load-bearing vests and backpacks with modular pockets employ some type of fastening system to hang the removable pockets there from. More specifically on military and civilian load-bearing vests (that is, fishing, hunting, photography, stadium vendors and the like), there is a need to be able to position necessary pockets or other such objects where they are most useful to the individual user.

Examples of such type of hardware employed for this task includes the use of hook and loop fasteners, keepers with slides, buttons, snap fasteners and soft snap devices. Generally the problems associated with these past methods and devices are the creation of unstable loads, unreliability, and expense. Furthermore, past systems are generally bulky and uncomfortable to the user.

Pockets that are sewn onto a vest cannot be repositioned and may not be useful to the user. In addition, pockets which form a permanent part of a vest or garment, when they become worn are completely useless. Until now removable pockets have been avoided on many designs because a secure, low bulk fastener that simulates sewn on stability does not exist.

A removable pocket allows the user to tailor his or her garment to best suit his or her needs, or replace the pockets, from time to time, with more suitable pockets for carrying specific items. Currently, the Army uses a metal slide keeper to hang canteens and ammunition pouches on equipment belts. Although the slide keeper is superior to other available technologies such as snap fasteners and Velcro, buttons, and hooks, such prior fasteners are difficult to engage, heavy, costly, subject to failing and protrude into the user causing discomfort.

Connecting devices that join one item to another are commonly used to fasten removable pockets or pouches to a vest, garment or belt. Several attachment methods of the past include Velcro, snap fasteners, hooks and metal or plastic keepers. The metal and plastic hardware generally rely on some mechanical means to be engaged or disengaged, and are bulky and thus cause discomfort to the user. Plastic and hardware fasteners also require activating a release bar or depressing levers or buttons. Consequently, it is evident that the above mentioned fasteners have several drawbacks. These drawbacks include, for example, bulk, weight and discomfort when used near the body, unwanted disengagement, difficulty in use, noise and cost. Velcro, for example, is very noisy when disengaged which is a concern to military personnel and sportsmen. Furthermore, Velcro is also very unreliable when clogged with mud, dirt or lint. Snap fasteners are also very unreliable and likely to prematurely release. Another fault of snap fasteners is that they only secure two items together in an exact location. This causes open areas around them.

The hook and loop fastener is generally unreliable in the attachment of objects to a garment since when subjected to extreme environmental conditions including water, heavy winds, etc. the attached object may easily become unattached. Further, the attachment and detachment of such objects by use of a hook and loop combination is generally noisy. The utilization of buttons or snaps in the attachment of an object to a garment is also generally unreliable since this form of attachment means, after numerous uses, has a tendency to inadvertently disengage the object from the garment. Furthermore, the use of hardware-like mounting devices in conjunction with securing an object to a garment can create irritating protrusions to the user as well as provide extra weight to the garment itself. The utilization of adhesives also create a problem since when subjected to harsh environmental conditions adhesives fail to provide the necessary adhering force for the objects to be maintained in position on the garment. The utilization of strong adhesives, on the other hand, create the problem of removing the objects from the garment. The utilization of laces, for example, to adhere an object to a garment is a time consuming attachment process and like some of the other procedures set forth above, in many instances, is unreliable in the fastening the object to the garment.

It is clearly evident the need exists for a light weight, low bulk (that is flat against the user), reliable and secure fastener. A challenge exists in designing a stable attachment device for removable pockets on load-bearing vests, sportsman's vests, luggage, etc. in which the removable pocket is as stable as being permanently sewn to the mounting surface while maintaining low bulk, and reliability.

It is therefore an object of the invention to provide an interlock attaching strap system which is readily usable to adhere objects together.

It is another object of this invention to provide an interlock attaching strap system which can be utilized to removably attach objects such as pockets and the like to a main garment.

It is still another object of this invention to provide an interlock attaching strap system which is free from bulky components and therefore prevents irritation to the user.

It is still a further object of this invention to provide an inexpensive interlock attaching strap system which securely fastens an object to a garment and yet quietly and without substantial effort releases the object therefrom.

SUMMARY OF THE INVENTION

The interlock attaching system of the present invention overcomes the problems associated with past locking systems and does so in an inexpensive and reliable manner. The present invention relies upon the fastening together of two objects by a flexible yet somewhat rigid strap, this strap being attached at one end thereof to one of the objects and then interwoven between the second object and the original object in a manner which permits the two objects to be attached together in a removable fashion and yet being as stable as these objects would be secured together in a permanent fashion. Because the interlock attaching system of the present invention provides little bulk, and has no complex hardware associated therewith it doesn't chafe the user when employed. Furthermore, the present invention allows for the connection to take place with virtually no noise when connected or disconnected. The flexibility of the straps utilized to attach two objects together permits the interlock attaching system of the present invention to flex when being employed as the user bends the torso.

In addition to being used as an interlock attaching system for the attachment of pockets or the like to a garment, it is also possible to use the present invention as an interlocking device which allows girth adjustments or waist adjustments when used with vests or belts in an overlapping fashion in order for the desired circumference to be obtained.

The system of the present invention is made up of a mounting panel on a first object with strips of webbing or any narrow fabric evenly spaced and sewn across the mounting surface. The spacing between the webbings are sufficient to allow a plurality of other webbings on the second object to fit there between. The webbings on the mounting panel are stitched thereto by perpendicular stitching such as to create channels therein which are utilized for the insertion of a strap therein, the strap being attached at one end thereof to the other object. At the other end of the strap is a fastening element which after passing through the webbings on the first object and then again through the webbings on the second object is attached to the second object by a fastener also secured to the second object. Even in the eventuality that the fasteners release the invention is designed such that the second object and first object will not permanently disengage until intentionally, physically separated.

For a better understanding of the present invention, together with other and further objects, reference is made to the following description taken in conjunction with the accompanying drawings, and its scope will be pointed out in the appended claims.

DETAILED DESCRIPTION OF THE PREFERRED EMBODIMENT

Figure 1:
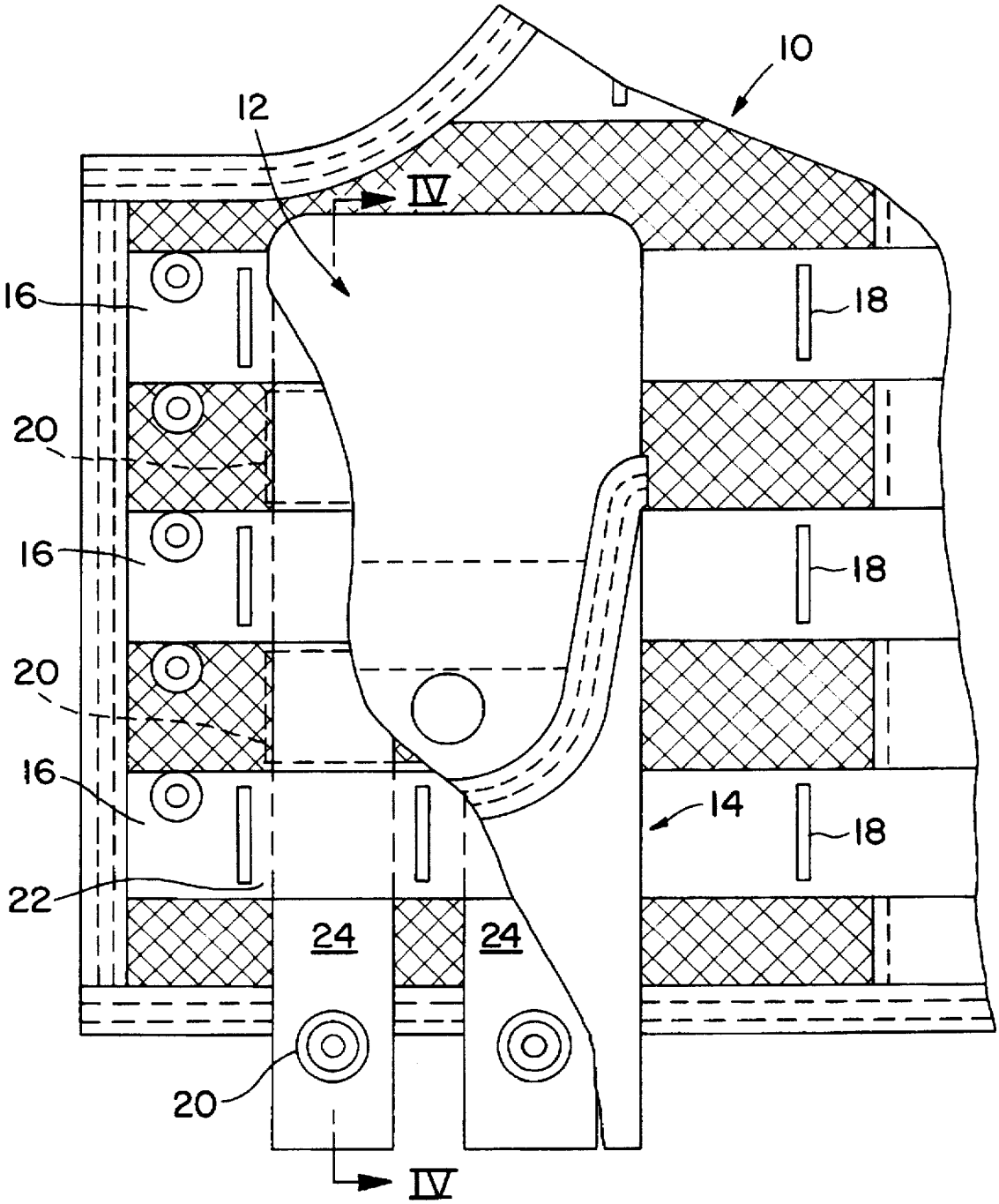
FIG. 1 is a front view of a segment of a garment having an object releasably secured thereto.

Reference is now made to FIG. 1 of the drawings which illustrates a segmented front view of a mounting surface of a first object, shown in the drawing as, for example a vest panel 10 and a second object in the form of, for example a pocket 12 or the like. The first object (vest panel 10) and the second object (pocket 12) are assembled together by the utilization of the interlock attaching strap system 14 of the present invention. The vest panel 10 is shown more clearly in FIG. 2 of the drawings while the pocket 12 or object to be attached to the vest panel 10 is shown pictorially in FIG. 3 of the drawings. The interlocking system is shown more clearly in FIG. 4 of the drawings, which in effect is a view taken along line IV—IV of FIG. 1. As stated above a pocket 12 and vest panel 10 are chosen for illustrating purposes only, however, this invention is not limited to attaching pockets to a vest and may be utilized for the removable fastening of any two objects together using the interlock attaching system 14 of the present invention. FIG. 1, by illustrating components thereof in segmented fashion shows how the interlock attaching system 14 of this invention is used to removable engage the pocket 12 to the vest 10.

Figure 2:
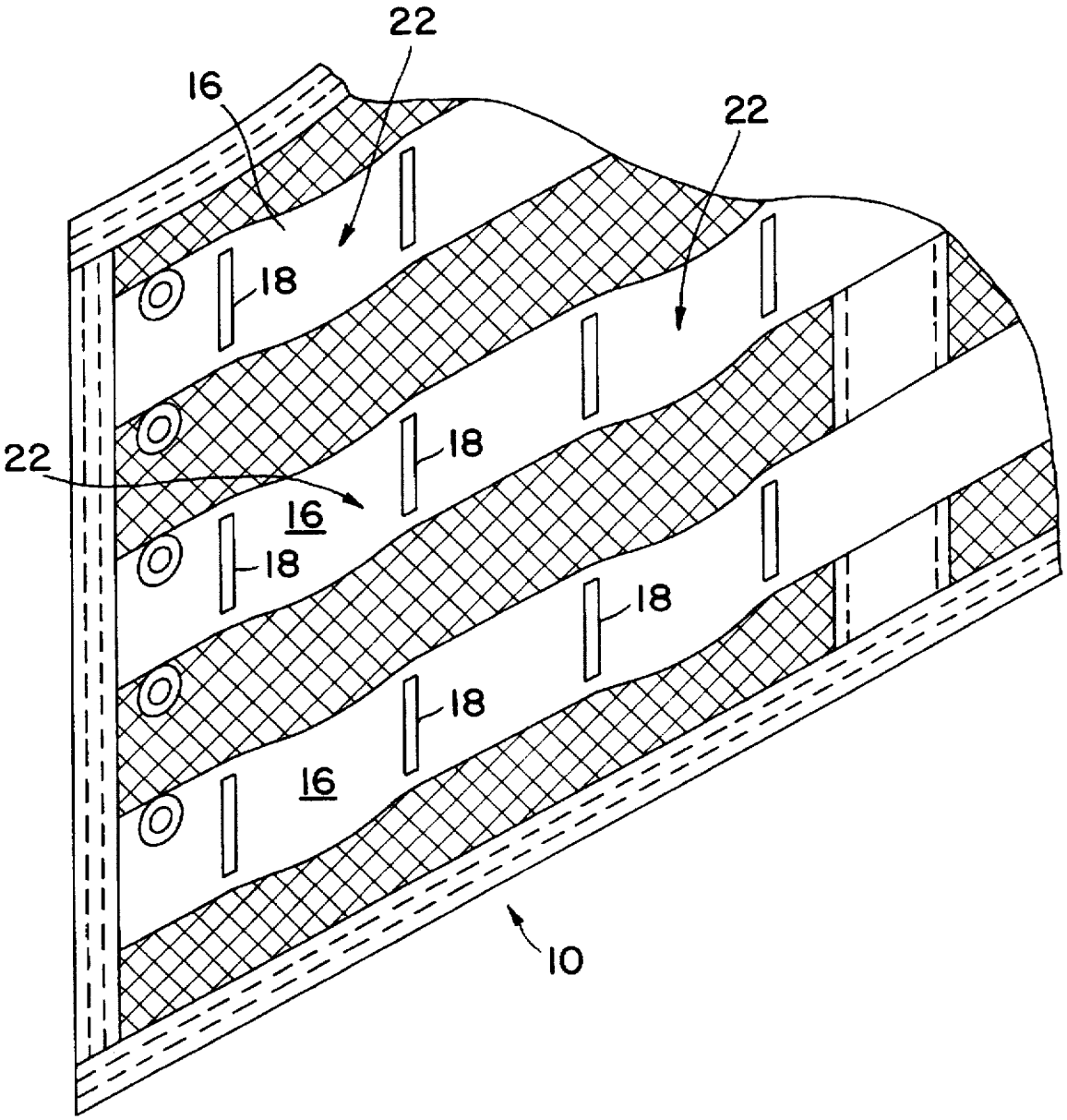
FIG. 2 is a front view of a segment of the garment of FIG. 1 illustrating the webs being stitched thereto.
Figure 3:
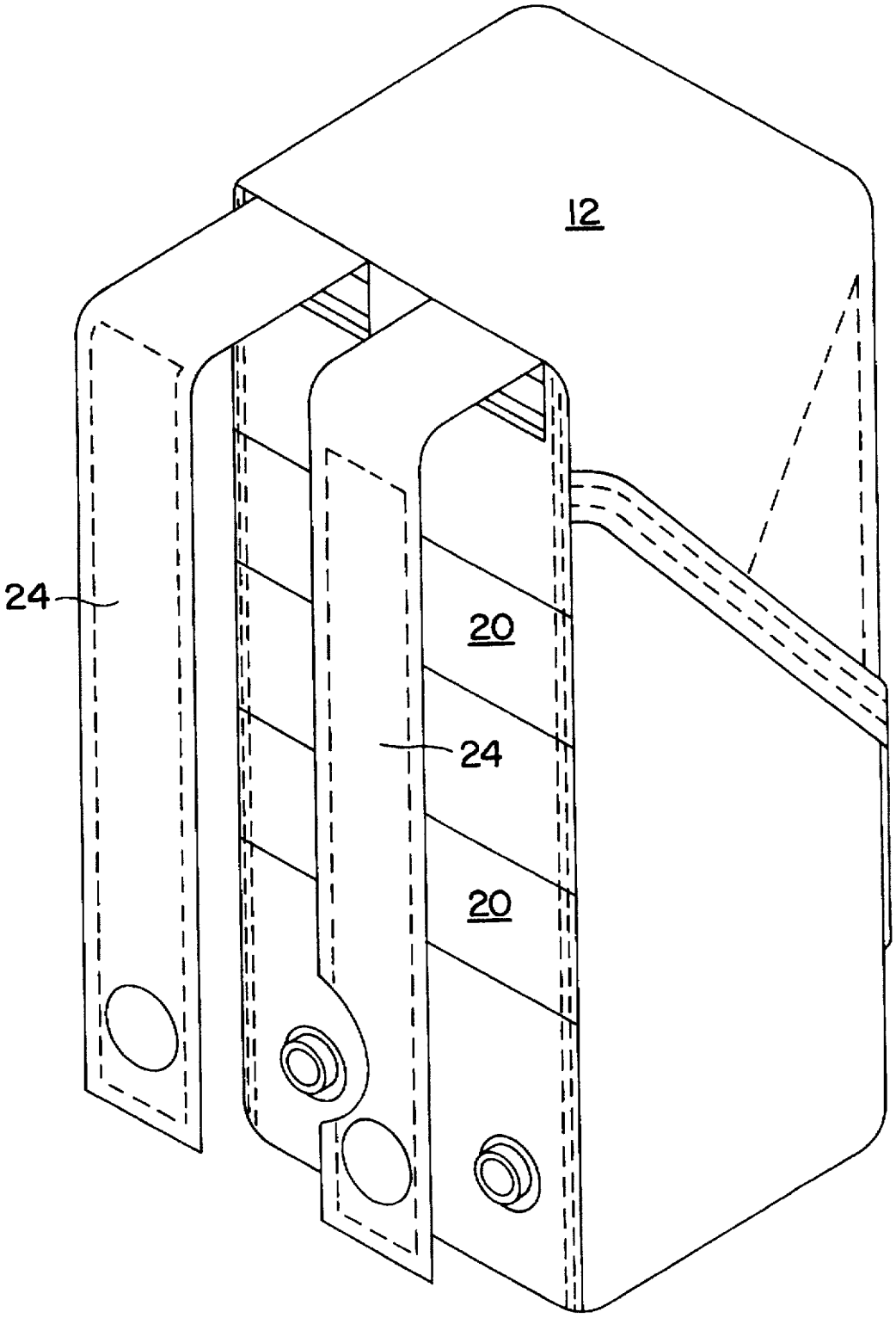
FIG. 3 is a pictorial illustration of an object to be removably secured to the garment of FIG. 1.
Figure 4:
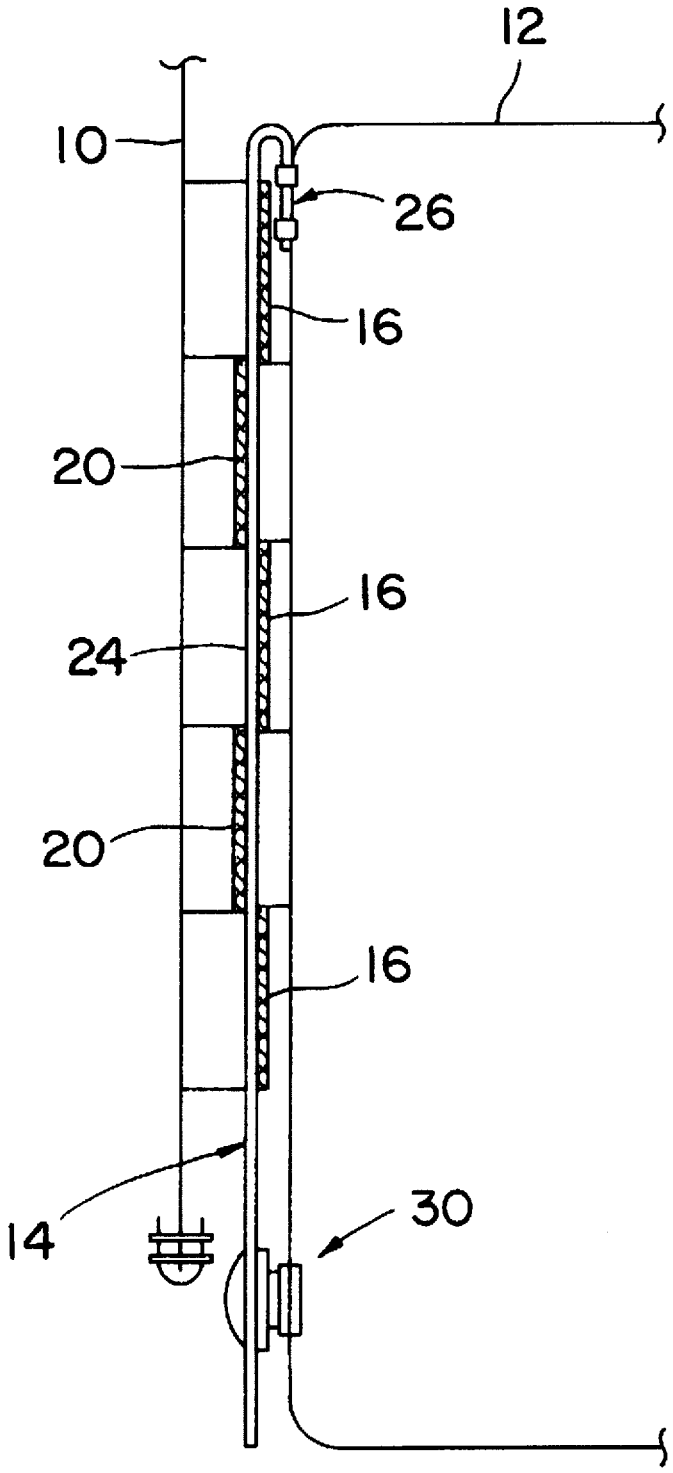
FIG. 4 is a schematic, cross-sectional view of the interlocking arrangement between the object and the garment taken along line IV—IV of FIG. 1.

As clearly shown in FIGS. 1 and 2 of the drawings, the vest panel 10 has a plurality of webbings 16 attached thereto, preferably by stitching 18. The strips of webbing 16 or any other suitable narrow fabric are generally evenly spaced one from the other and sewn across the mounting surface thereof. The spacing between the strips of webbing 16 should be of sufficient dimension to permit the placement therebetween of another series of webbings 20 illustrated in FIGS. 1 and 3 of the drawings as being attached to the object or pocket 12. The stitching 18 which holds the strips of webbing 16 in place on the mounting surface or vest 10 is perpendicular to the webbing and spaced apart so as to create channels 22 therebetween. The channels 22 are of sufficient size to accommodate straps 24 which are attached at one end thereof to the pocket or objects to be mounted as shown in FIG. 3 of the drawing. Any suitable attachment means such as rivets or adhesive or stitching as shown in FIG. 4 of the drawings, illustrated as attachment means 26, can be utilized to fixedly secure one end of the strap 24 to the pocket or object 12. As shown in FIGS. 1 and 4 of the drawings any suitable fastening mechanism 30, preferably in the form of a male and female snap section are utilized to attach the other end of the strap 24 to the object 12.

Each of the straps 24 are preferably made of a flexible material such as cloth which can be stiffened by the sewing of a thin flexible plastic material to the strap fabric, or in some instances by treating the strap fabric 24 by a chemical which is able to create some stiffness in the flexible strap 24. Although not limited to the following dimensions, a preferred embodiment of the present invention utilizes one inch texture nylon webbing stiffened with a length of 0.03 inch polyethylene plastic sewn thereto. One inch nylon webbing may also utilized for the strips of webbing 16 and 20. Although the drawings illustrate three lengths of webbing 16 utilized on the mounting panel or vest panel 10 and two strips of webbing 20 mounted on the object or pocket 12, the present invention can also be employed with as little as two webbings 16 and a single webbing 20. In most instances, however the present invention is employed with a greater number of horizontal webbings on the vest panel 10 than on the pocket 12.

In operation, as clearly illustrated in FIG. 4 of the drawings the end of the straps 24 are passed in sequence first through a strip of webbing 16 on the vest panel 10 then through the strip of webbing 20 on the object or pocket 12 and back through the strip of webbing 16 on the vest 10 and further back through the strip of webbing 20 on the pocket 12 in an interlocking fashion which enables the pocket or object 12 which is removably attached to the mounting panel or vest 10 to be attached thereto in a manner which is both easily accomplished and secure. After sequentially interlocking the various webbings 16 and 20, the end of each of the straps 24 is securely fastened to the object of pocket 12 by the snap fasteners 30. It should be realized that the interlocking system 14 of the present invention is effective even if the fastening components 30 become disengaged one from the other. The interlocking of the strap with the strips of webbing will provide a relatively secure interlock engaging system which will maintain the pocket or object 12 in an engagement with the mounting panel or vest 10.

This system, although it finds its main utility in the connection or attachment of pockets or the like to a mounting panel, can also be utilized in the adjustable attachment of any types of objects one to the other. Furthermore, this type of system as illustrated in the drawings of this invention can be utilized for an adjustable interconnection for vests or belts by overlapping two pieces of material in a desired circumference and fastening one to the other.

Although this invention has been described with reference to particular embodiments, it will be understood that this invention is also capable of further and other embodiments within the spirit and scope of the appended claims.

What is claimed is:

1. An interlocking attaching system for removably securing objects to a garment, said system comprising:

at least one object and a garment;

said object having means thereon for removably engaging said garment and means thereon for removably receiving said engaging means in an interlocking fashion;

said garment having means thereon for removably receiving said engaging means in an interlocking fashion;

means operably associated with said engaging means and said object for removably securing said engaging means to said object after said engaging means has passed through said receiving means on said garment and said receiving means on said object in an interlocking fashion;

said engaging means on said object comprises at least one strap, said strap attached at one end thereof to said object and said strap having an other end;

said receiving means on said garment comprises a plurality of spaced apart webbings, said webbings being secured to said garment at spaced apart locations such that the spacing between locations is of sufficient size to receive said strap therethrough; and p1 said means on said object for removably receiving said strap comprises a plurality of spaced apart webbings.

2. An interlocking attaching system as defined in claim 1 wherein said strap is flexible with some degree of stiffness.

3. An interlocking attaching system as defined in claim 2 wherein said strap is made of a flexible material and said stiffness is accomplished by a relatively stiff material secured thereto.

4. An interlocking attaching system as defined in claim 2 wherein said object comprises a pocket.

5. An interlocking attaching system as defined in claim 1 wherein said means for removably securing said engaging means to said object comprises a pair of fastening components, one of said components being on said engaging means and the other of said components being on said object.

6. An interlocking attaching system as defined in claim 1 wherein each of said webbings are secured to said garment at spaced apart locations by stitching, said stitching being perpendicular to the longitudinal direction of said webbings.

7. An interlocking attaching system as defined in claim 1 wherein said object is removably interlocked to said garment by passing said other end of said strap through one of said webbings on said garment, then through one of said webbings on said object, back through another one of said webbings on said garment, then back to said object until the other end of said strap engages said object.

8. An interlocking attaching system for removably attaching objects together, said system comprising:

a first object having a plurality of web-like elements thereon;

a second object having at least one strap-like element fixedly secured thereon and a plurality of web-like elements thereon;

wherein said second object is removably fastened to said first object by interlocking said strap-like element sequentially through aid web-like elements; and means operably associated with an end of said strap-like element for removably securing said strap-like element to said second object.

9. An interlocking attaching system as defined in claim 8 wherein said web-like elements on said first object are secured to said first object at spaced apart locations such that the spacing between locations is of sufficient size to receive said strap-like element therethrough.

10. An interlocking attaching system as defined in claim 9 wherein said strap-like element is flexible with some degree of stiffness.

11. An interlocking attaching system as defined in claim 10 wherein said means for removably securing said strap-like element to said second object comprises a pair of fastening components, one of said components being adjacent said end of said strap-like element and the other of said components being on said second object.

12. An interlocking attaching system as defined in claim 11 wherein each of said web-like elements on said first object are secured to said first object at spaced apart locations by stitching, said stitching being perpendicular to the longitudinal direction of said web-like elements in order to form a channel there between for receiving said strap-like element.

13. An interlocking attaching system as defined in claim 12 wherein there are a pair of strap-like elements and each of said strap-like elements is made of a flexible material and said stiffness is accomplished by a relatively stiff material secured thereto.

14. An interlocking attaching system as defined in claim 13 wherein said first object is a vest panel and said second object is a pocket.

15. An interlocking attaching system as defined in claim 13 wherein said second object is removably interlocked to said first object by passing said end of said strap-like element through one of said web-like elements on said first object, then through one of said web-like elements on said second object, back through another one of said web-like elements on said first object, then back to said second object where said components are fastened to each other.

16. A method of securing two objects together in an interlocking fashion comprising the steps of:

passing an end of a strap affixed to the first of said objects through a webbing on the second of said objects;

thereafter, passing said end of said strap through a webbing on the first of said objects;

thereafter, passing said end of said strap back through another webbing on the second of said objects; any succeeding passing of said end of said strap through said webbings on said first object and said second object in an interlocking fashion being dependent on a dimension of said first of said objects; and securing said end of strap to said first object.

17. A of method securing two objects together in an interlocking fashion as defined in claim 16 wherein said first object is a pocket and said second object is a garment.

* * * * *